United States Patent [19]

Beckman et al.

[11] 4,383,336

[45] May 17, 1983

[54] HAND COVERING

[76] Inventors: Marshall H. Beckman, R.D. #1 Box 198, Normandy Ct., West Hurley, N.Y. 12491; Frederick L. Ballet, 44 Brittany Farms Rd. K106, New Britain, Conn. 06053

[21] Appl. No.: 298,578

[22] Filed: Sep. 2, 1981

[51] Int. Cl.[3] ..... A41D 25/00

[52] U.S. Cl. ..... 2/158

[58] Field of Search ..... 2/158, 159, 163, 169, 2/160, 161 R, 161 A, 168, 16

[56] References Cited

U.S. PATENT DOCUMENTS

| | | | |
|---|---|---|---|
| 2,274,335 | 2/1942 | Kennedy | 2/158 |
| 2,451,837 | 10/1948 | La Lonck et al. | 2/158 |
| 3,299,441 | 1/1967 | Slimovitz | 2/158 |

*Primary Examiner*—Doris L. Troutman

[57] ABSTRACT

A mitten-like hand covering is disclosed having a transverse slit-like opening through which one or more fingers, or the entire hand, may pass. Upper and lower elastic strips are attached along the upper and lower sides of the slit-like opening. Upper and lower fastening members of the Velcro-type are attached respectively over the upper and lower elastic strips with the fastening side of each fastening member facing away from the hand enclosing member. The elastic strips stretch freely beneath the fastening members. When the fingers of an enclosed hand are clenched, the fastening members fasten together to completely close the opening. When the fingers are extended and press against the inside tip of the hand covering, the fasteners are unfastened permitting fingers or the entire hand to pass through the opening. The hand covering may be carried on the wrist or forearm by passing the entire hand through the opening.

14 Claims, 5 Drawing Figures

HAND COVERING

This invention relates to hand coverings and more particularly to mittens which can be conveniently carried when not worn.

Runners and other sportsmen have the problem of carrying mittens after their removal from hands which become too warm due to exercise, especially when there is no comfortable and convenient place to store them in or attached to their clothes.

The principal object of this invention, therefore, is to provide mittens which, when removed from hands, can be comfortably and conveniently carried.

Another object of the invention is to provide such mittens which are easy to use, simple to construct and inexpensive to manufacture.

Briefly, in accordance with the preferred embodiment of the invention, a mitten is provided comprising a flexible hand enclosing member having a transverse slit-like opening through which one or more fingers may be passed. Upper and lower elastic strips are attached along the upper and lower sides of the slit-like opening. Upper and lower fastening members are attached respectively over the upper and lower elastic strips with the fastening side of each fastening member facing away from the hand enclosing member. When the fingers of an enclosed hand are clenched, the fastening members fasten together to completely close the opening; and when the fingers are extended the fastening members are unfastened permitting one or more fingers or the entire hand to pass through the opening.

A feature of the invention is that the elastic strips urge the slit-like opening shut when the hand is unclenched but the opening can be separated to permit air circulation within the mitten by extending and/or spreading the fingers within the mitten so that the fingers press against the outer perimeters of the mitten.

An advantage of the invention is that it may be worn by outdoor workers, police and military personnel and others who have a need to temporarily remove the mitten to perform a task which requires use of the entire hand, or even one or more fingers when they will do the job.

For runners, a special advantage is that upper body tension may be reduced by unclenching the hands without unfastening the slit-like opening so that there is no loss of warmth. When the hand is unclenched inside the sealed mitten, the muscles in the arm and upper torso are relaxed, as well as in the hand. The fastening members make this possible because the hand does not have to be clenched to hold the opening in a closed position.

Another advantage of the invention is that the slit-like opening may be opened for ventilation or closed for warmth using only the enclosed hand.

Other objects, features and advantages of the invention will be apparent from the following detailed description of the invention taken together with the accompanying drawings wherein:

FIG. (FIG.) 1 is a front elevational view of a hand covering in accordance with the preferred embodiment of the invention using a sock-like member as the flexible hand enclosing member and showing an enclosed hand in dotted outline.

Figure 1:
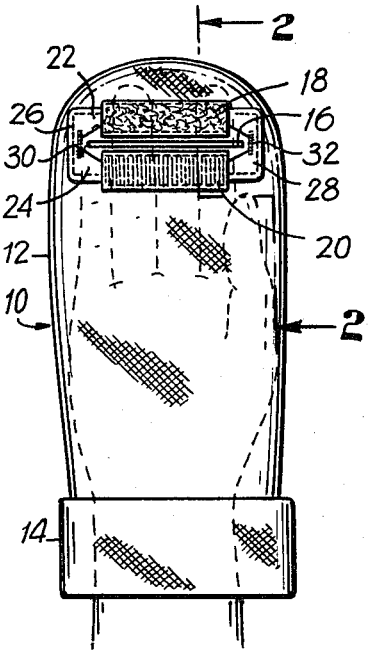
Figure 2:
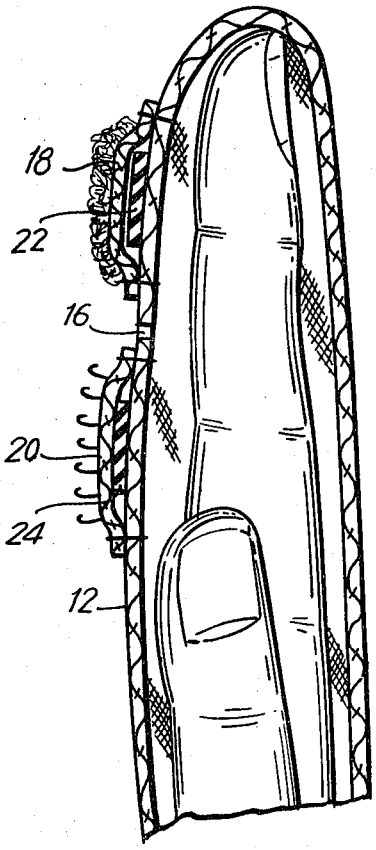
FIG. 2 is a cross-sectional view along the lines of 2—2 of FIG. 1 showing the details of the upper and lower elastic strips and fastening members abutting the transverse slit-like opening shown open in the ventilating position.

Referring to FIGS. 1 and 2, the hand covering is a knitted mitten 10 (corresponding to the foot part of a knitted sock) and comprises the hand portion 12 and cuff 14. A transverse slit-like opening 16 is provided in the hand portion 12 along the second joints of an enclosed hand. An upper fastening member 18 has its lower edge sewn along the upper edge of the opening 16 and a lower fastening member 20 has its upper edge sewn along the lower edge of the opening 16. The upper and lower fastening members 18,20 also have their outer edges sewn to the hand portion 12.

The fastening members 18,20 are Velcro-type connecting strips which consist of two parts, one being a nonwoven material such as felt and the other part being a flexible material provided with a plurality of hook-like loops of stiff resilient plastic material, such as nylon, projecting from the face of the material. When the two connecting strips are pressed together the hooks lock with the fibers of the felt holding the two strips together. The strips can be separated by peeling one away from the other. The connection and separation may be repeated innumerable times. In the preferred embodiment of the invention the upper fastening member 18 is the felt strip and the lower fastening member 20 is the plastic hook strip.

An upper elastic strip 22 passes freely beneath the upper fastening member 18 and is sewn to the hand portion 12 of the mitten 10 at each end of the strip 22. A lower elastic strip 24 passes freely beneath the lower fastening member 20 and also is sewn to the hand portion 12 at each end of the strip 24. The elastic strips 22 and 24 are urged together because they are connected at each end by end sections 26 and 28 by virtue of being made from a double width elastic strip which is cut along its midpoint between the end sections 26 and 28. Bar tacks 30 and 32, at the inside edges of end sections 26 and 28, prevent the tearing of end sections 26 and 28 while further attaching the upper and lower fastening members 18,20 to the hand portion 12 of the mitten 10.

The hand covering is preferably constructed in the following steps (see FIGS. 1 and 2):

(1) Transverse slit-like opening 16 is cut through hand portion 12 of mitten 10.

(2) The inside edges of the upper and lower fastening members 18,20 are sewn along the opening 16 with their connecting strips face up, the felt connecting strip being at top and the hook connecting strip at bottom.

(3) A double width elastic strip is cut along its longitudinal midpoint and between its ends to provide upper and lower elastic strips 22,24 connected at each end by end sections 26,28.

(4) The upper elastic strip 22 is positioned beneath upper fastening member 18 and, with stretching, the lower elastic strip 24 is positioned beneath lower fastening member 20.

(5) The end sections 26,28 are stitched to the hand portion 10 together with bar tacks 30,32.

(6) The upper edge of upper fastening member 18 and the lower edge of lower fastening member 20 are stitched to the hand portion 10.

The length of opening 16 is preferably about the width of four fingers so that the entire hand may be passed through the opening 16 when the opening 16 is stretched.

The bar tacks 30,32 serve to prevent further extension of the opening 16 when the hand is extended through opening 16. The upper and lower elastic strips 22,24 stretch freely beneath the upper and lower fastening members 18 and 20 when a hand is extended through opening 16.

Figure 3:
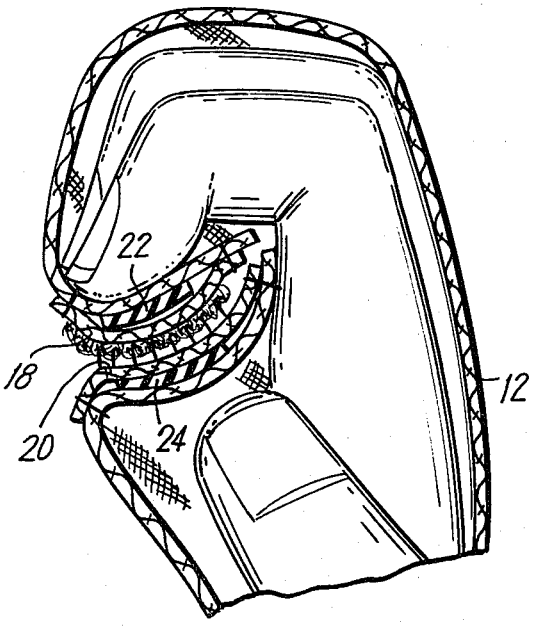
FIG. 3 is a side elevational view, partly in cross section, showing how the upper and lower fastening members are attached to close the slit-like opening by making a fist of the enclosed hand.

In FIG. 2 the hand is shown pushing against the inside of the mitten 10 urging opening 16 into an open condition to provide ventilation of the hand when desired. Otherwise, upper and lower elastic strips 22,24, which push against the inside edges of upper and lower fastening member 18,20, urge the opening 16 toward a closed position. But when it is desired that the opening 16 be sealed, the enclosed hand is clenched in a fist, as shown in FIG. 3, which presses the fastening members 18,20 together locking them and sealing opening 16. Extension of the clenched hand to the FIG. 2 position preferably by extending and separating the fingers (including the thumb) and pressing the fingers against the inside perimeter of the mitten 10, will unlock the fastening members 18,20 without using the other hand. Alternatively, the hand may be unclenched to reduce upper body tension without unlocking fastening members 18,20. There is enough space between the tips of the fingers and the inside top of the mitten 10 to allow this.

Figure 4:
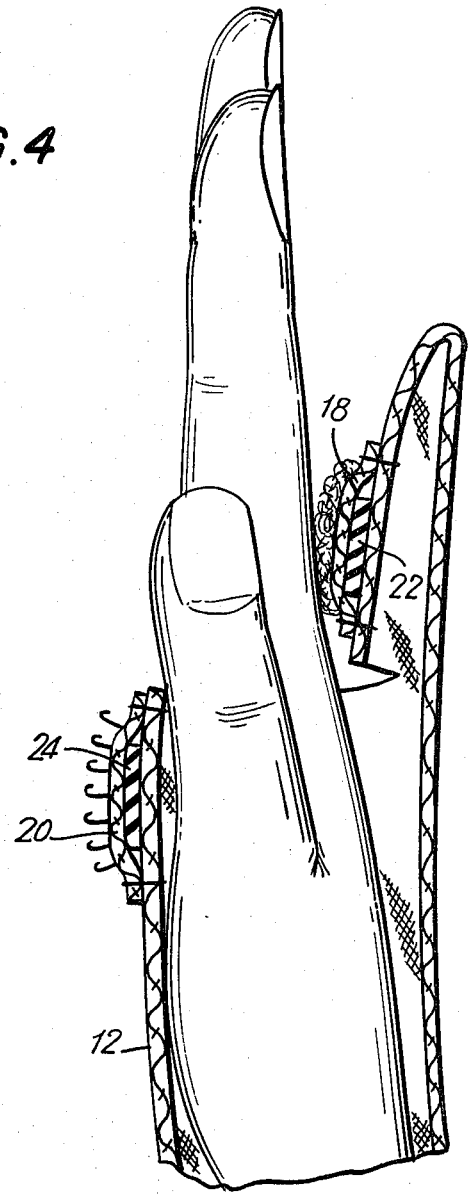
FIG. 4 is a side elevational view, partly in cross section, showing the extension of fingers through the slit-like opening.

In FIG. 4 the fingers of the hand are shown extended through opening 16 making them available to perform any task requiring the use of the fingers.

Figure 5:
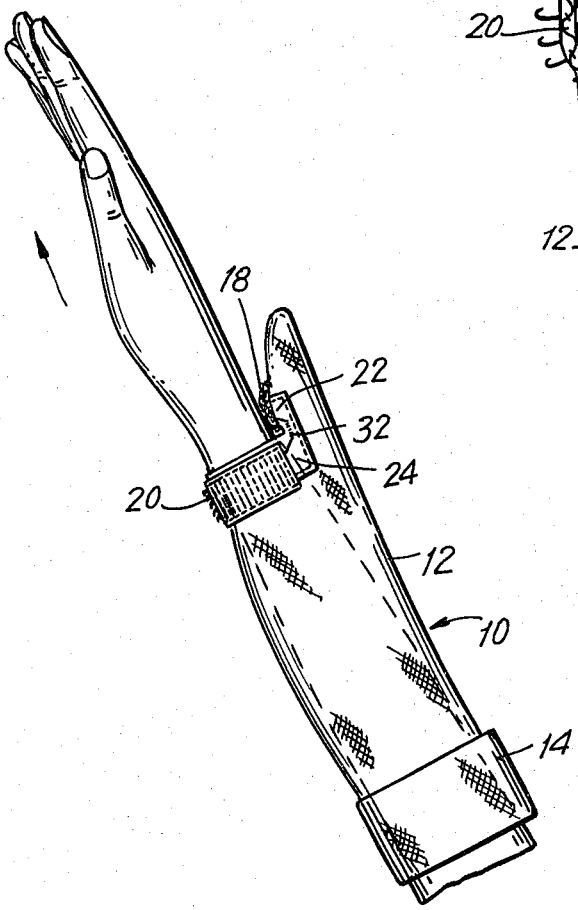
FIG. 5 is a side elevational view showing the entire hand passed through the slit-like opening so that the hand covering is conveniently carried on the forearm.

In FIG. 5 the entire hand has been passed through opening 16 by pulling cuff 14 along the forearm so that the mitten 10 is conveniently carried on the forearm, or, alternatively, by working the fingers through the opening 16 and then abducting the fingers to urge the opening 16 around the wrist. This procedure is especially valuable for runners who desire to remove their hand coverings when their hands are too warm and have no convenient place to store or attach the removed glove or mitten. In this position, as well as in the FIG. 4 position of the hand, the upper fastening member 18 is in contact with the back of the hand or the back of the fingers but, since upper fastening member 18 comprises the Velcro-type connecting strip made from felt, there is no irritation to the hand or fingers, as there would be if the upper fastening member 18 comprised plastic hooks.

The material of the mitten 10 is preferably knitted wool or cotton although any conventional glove or mitten material, like leather, may be used. The elastic strips 22,24 are made from conventional elastic sewing ribbon.

What is claimed is:

1. A hand covering comprising:

(a) a flexible hand enclosing member having a transverse slit-like opening through which one or more fingers may be passed;

(b) an upper elastic strip attached to said hand enclosing member and extending transversely along the upper side of said slit-like opening;

(c) a lower elastic strip attached to said hand enclosing member and extending transversely along the lower side of said slit-like opening;

(d) an upper fastening member attached to said hand enclosing member and extending transversely over said upper elastic strip with its fastening side facing away from said upper elastic strip; and (e) a lower fastening member, adapted to coact with said upper fastening member, attached to said hand enclosing member and extending transversely over said lower elastic strip with its fastening side facing away from said lower elastic strip;

(f) whereby when fingers of a hand enclosed by said hand enclosing member are clenched said upper and lower fastening members fasten together to fasten said slit-like opening closed, and when the clenched fingers are extended and pressed against the inside end of said hand enclosing member said fastening members are unfastened to permit one or more of the fingers to pass through said slit-like opening.

2. The hand covering of claim 1 wherein said upper and lower elastic strips are each attached to said hand enclosing member at their ends only so that each elastic strip may stretch freely beneath the corresponding fastening member.

3. The hand covering of claim 1 or claim 2 wherein said slit-like opening is about four fingers wide so that when stretched the entire hand may pass through said opening.

4. The hand covering of claim 3 wherein said upper and lower fastening members are mating Velcro-type fasteners.

5. The hand covering of claim 3 wherein said upper fastening member consists of a nonwoven material and said lower fastening member consists of a plurality of small hook-like loops of a stiff resilient plastic material.

6. The hand covering of claim 1 wherein said flexible hand enclosing member comprises a mitten.

7. The hand covering of claim 1 wherein said upper and lower elastic strips comprise a single elastic strip with a longitudinal slit intermediate its ends along the midpoint of said single elastic strip whereby the resulting upper and lower elastic strips urge their corresponding fastening strips into a closer relationship thereby urging said slit-like opening shut.

8. The hand covering of claim 7 further including a bar tack at each end of said longitudinal slit.

9. A hand covering comprising:

(a) a flexible hand enclosing member having a transverse slit-like opening through which one or more fingers may be passed;

(b) an upper fastening member having an upper edge directly attached to an upper portion of said hand enclosing member and extending transversely along the upper side of said slit-like opening with its fastening side always facing away from said attached upper portion of said hand enclosing member; and (c) a lower fastening member, adapted to coact with said upper fastening member, attached directly to a lower portion of said hand enclosing member and extending transversely along the lower side of said slit-like opening with its fastening side always facing away from said attached lower portion of said hand enclosing member;

(d) whereby when fingers of a hand enclosed by said hand enclosing member are clenched said upper and lower fastening members fasten together to fasten said slit-like opening closed, and when the clenched fingers are extended inside said hand enclosing member said fastening members are unfastened by the extending fingers pushing against the inside of said hand enclosing member to permit one or more of the fingers to pass through said slit-like opening.

10. The hand covering of claim 9 wherein said slit-like opening is about four fingers wide so that the entire hand may pass through said opening when it is stretched.

11. The hand covering of claim 10 wherein said upper and lower fastening members are mating Velcro-type fasteners.

12. The hand covering of claim 11 wherein said upper fastening member consists of unwoven material and said lower fastening member consists of a plurality of small hook-like loops.

13. The hand covering of claim 9 wherein said flexible hand enclosing member is a sock-like member.

14. A method of constructing a hand covering from a flexible hand enclosing member to produce a closeable opening through which one or more fingers may pass comprising the steps of:

(a) cutting a transverse slit-like opening in one side of the hand enclosing member at a position corresponding to about the second joint of fingers of a hand enclosed in said hand enclosing member, said opening having a length sufficient to permit the passage of one or more fingers;

(b) attaching along the upper edge of said opening the bottom edge of an upper fastening member;

(c) attaching along the lower edge of said opening the top edge of a lower fastening member adapted to connect with said upper fastening member when said fastening members are pressed together;

(d) longitudinally cutting an elastic strip intermediate its ends to produce an upper elastic strip and a lower elastic strip connected together at each of the ends;

(e) positioning the upper elastic strip beneath the upper fastening member;

(f) positioning the lower elastic strip beneath the lower fastening member;

(g) attaching the ends of the elastic strips to said enclosing member; and (h) attaching the upper edge of said upper fastening member and the lower edge of said lower fastening member to said enclosing member.

* * * * *